US005180997A

United States Patent [19]

Stern et al.

[11] Patent Number: 5,180,997

[45] Date of Patent: Jan. 19, 1993

[54] MICROSTRIP HIGH REVERSE LOSS ISOLATOR

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 782,190

[22] Filed: Oct. 24, 1991

[51] Int. Cl.[5] ..... H01P 1/36

[52] U.S. Cl. ..... 333/24.2; 333/1.1

[58] Field of Search ..... 333/1.1, 24.2

[56] References Cited

U.S. PATENT DOCUMENTS

| | | | |
|---|---|---|---|
| 3,534,296 | 10/1970 | Carr | 333/1.1 |
| 4,749,966 | 6/1988 | Stern et al. | 333/1.1 |
| 4,754,237 | 6/1988 | Stern et al. | 333/1.1 |
| 4,777,454 | 10/1988 | Stern et al. | 333/1.1 |
| 4,806,886 | 2/1989 | Stern et al. | 333/24.2 |

OTHER PUBLICATIONS

Smoczynski, *Cascade-Coupled Single Junction Circulators*, Proc. of the 4 Colloquium on Microwave Communication, Budepest, Hungary, Apr. 1970.

*Primary Examiner*—Paul Gensler

*Attorney, Agent, or Firm*—Michael Zelenka; Robert A. Maikis

[57] ABSTRACT

A millimeter wave microstrip, high reverse loss isolator is provided comprising a monolithic ferrite element disposed on one surface of a section of microstrip dielectric substrate having a ground plane on the opposite substrate surface. The ferrite element has a pair of right prism-shaped central portions each having three prism faces and two downwardly sloping transition arm portions extending radially outwardly from two of the prism faces. A bar shaped connecting arm portion interconnects the remaining prism faces of the pair of central portions. All of the top surfces of the ferrite element are covered with microstrip conductor and four sections of microstrip conductor are disposed on the surface of the substrate in alignment with the downwardly-sloping transition arm portions of the element. Permanent magnet biasing means mounted on the ground plane beneath the ferrite element central portions cause these portions to act as microstrip Y-junction circulators. The shared connecting arm portion of the element connects the circulators in tandem so that a four port (two ports terminated) high reverse loss isolator results.

6 Claims, 3 Drawing Sheets

MICROSTRIP HIGH REVERSE LOSS ISOLATOR

GOVERNMENT INTEREST

The invention described herein may be manufactured, used and licensed by or for the Government for governmental purposes without the payment to us of any royalties thereon.

BACKGROUND OF THE INVENTION

I. Field of Invention

This invention relates to microstrip transmission lines and microstrip transmission line devices operating in the microwave and millimeter wave regions of the frequency spectrum and more particularly to a microstrip high reverse loss isolator for use with such microstrip transmission lines and devices.

II. Description of the Prior Art

Isolators are essentially two port, non-reciprocal attenuation devices which are used in RF transmission line applications, such as in the millimeter wave region of the frequency spectrum, for example, to provide a low loss transmission of electromagnetic wave energy from the input port to the output port but only a very limited or attenuated transmission of energy from the output port to the input port. They are often used in both military and commercial radar and communication systems for signal source protection. For example, isolators may be used in radar or communication systems to prevent or limit unwanted high energy millimeter wave weapons signals or other high level unwanted millimeter wave signals from entering the system via the antenna. For these applications, the reverse loss characteristic of the isolator should be as high as possible to provide a maximum isolation for the protected radar or communications system. Since planar type circuitry using microstrip is widely used in millimeter wave frequency applications because it permits the design of equipment having extremely small size and low weight which is desirable for many items of military and commercial equipment, such as the aforementioned radar equipment, for example, it is important that a suitable isolator for use with such applications not only have a high reverse loss but also be capable of being used with microstrip circuitry. Finally, a suitable isolator satisfying the foregoing criteria should also be capable of being fabricated relatively easily and inexpensively and should readily lend itself to assembly by means of current automated assembly techniques.

SUMMARY OF THE INVENTION

It is an object of this invention to provide a microstrip isolator which has a very high reverse loss characteristic which is suitable for us in the millimeter wave region of the frequency spectrum.

It is a further object of this invention to provide a microstrip high reverse loss isolator which is readily usable with microstrip transmission lines and microstrip transmission line devices.

It is a still further object of this invention to provide a microstrip high reverse loss isolator of relatively simple design which readily lends itself to monolithic fabrication and automated assembly techniques.

It is another object of this invention to provide a microstrip high reverse loss isolator of small size and low weight which is relatively inexpensive to manufacture and to assemble.

Briefly, the microstrip high reverse loss isolator of the invention comprises a microstrip dielectric substrate having substantially planar top and bottom surfaces, an electrically conductive ground plane mounted on the bottom surface of the substrate and a ferrite element mounted on the top surface of the substrate. The ferrite element has a pair of spaced apart central portions. Each of the central portions is shaped as a right prism having three rectangular prism faces of substantially equal area and top and bottom prism bases shaped as equilateral triangles. The bottom prism base of each of the pair of central portions abuts the top surface of the substrate. A connecting arm portion of the ferrite element extends radially outwardly from and joins one of the prism faces of one of the pair of central portions to one prism face of the other of the pair of central portions, the connecting arm portion having a top surface joining the top bases of the pair of central portions and a bottom surface joining the bottom bases of the pair of central portions. The ferrite element also has four transition arm portions extending radially outwardly from the four remaining prism faces of the pair of central portions, each of the transition arm portions having a height which decreases linearly from the full height of the top prism base above the bottom prism base of the central portion from which it extends at the end of the transition arm portion which abuts the prism face to zero height at the other end of the transition arm portion, so that the top surface of each of the transition arm portions slopes downwardly from the top prism base of the central portion from which it extends to the top surface of the substrate and the bottom surface of each transition arm portion is coplanar with the bottom prism base of the central portion from which it extends and abuts the top surface of the substrate. Electrically conductive microstrip conductor means are associated with each of the ferrite element arm portions. The microstrip conductor means have a first portion thereof mounted on the top bases of the pair of ferrite element central portions and the top surface of the ferrite element connecting arm portion, a second portion thereof extending down the sloping top surface of the ferrite element transition arm portion associated therewith and a third portion thereof mounted on the top surface of the substrate in alignment with the ferrite element transition arm portion associated therewith. Finally, magnetic biasing means for applying dc magnetic fields having the same magnetic direction between the top and bottom prism bases of the pair of prism shaped ferrite element central portions cause the pair of ferrite element central portions to act as a pair of tandem connected microstrip Y-junction circulators so that the third portions of the microstrip conductor means act as the ports of the microstrip isolator.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
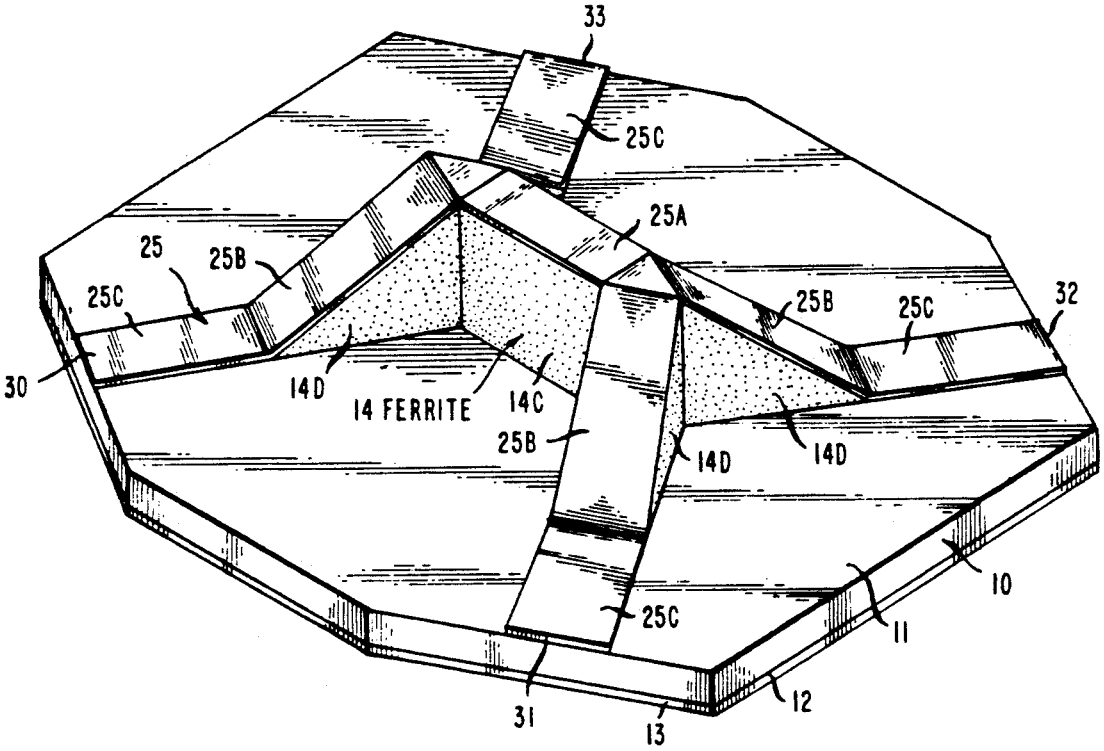
FIG. 1 is a perspective view of the microstrip high reverse loss isolator of the invention.
Figure 2:
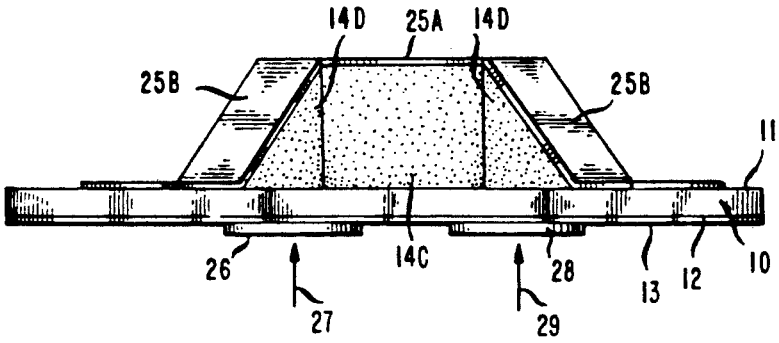
FIG. 2 is a front elevational view of the isolator of FIG. 1.
Figure 3:
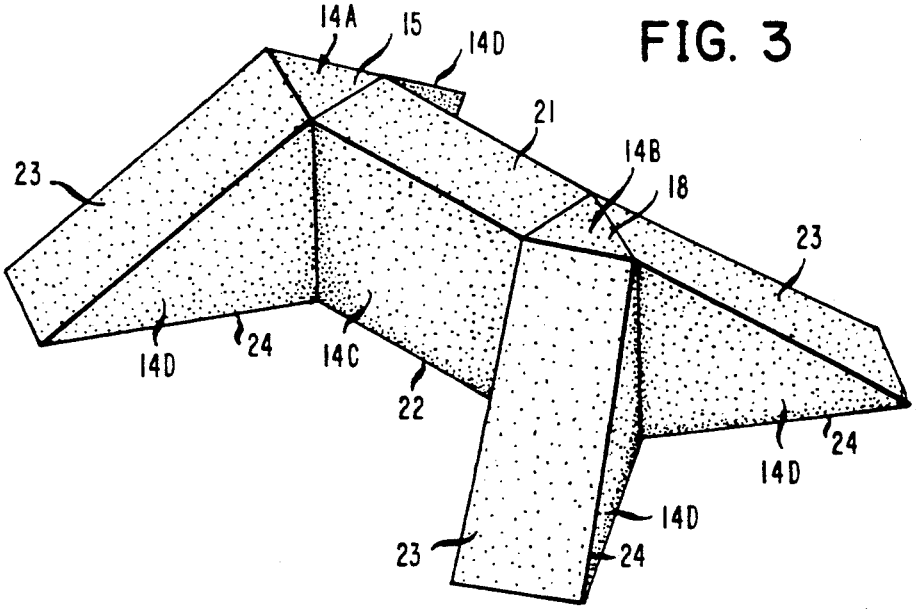
FIG. 3 is a perspective view of the ferrite element which is mounted on the substrate of the isolator of FIGS. 1 and 2.
Figure 4:
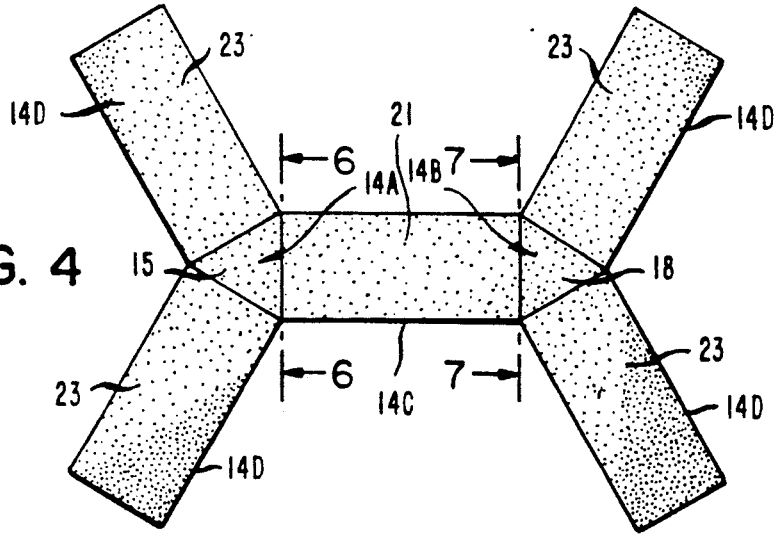
FIG. 4 is a top plan view of the ferrite element shown in FIG. 3.
Figure 5:
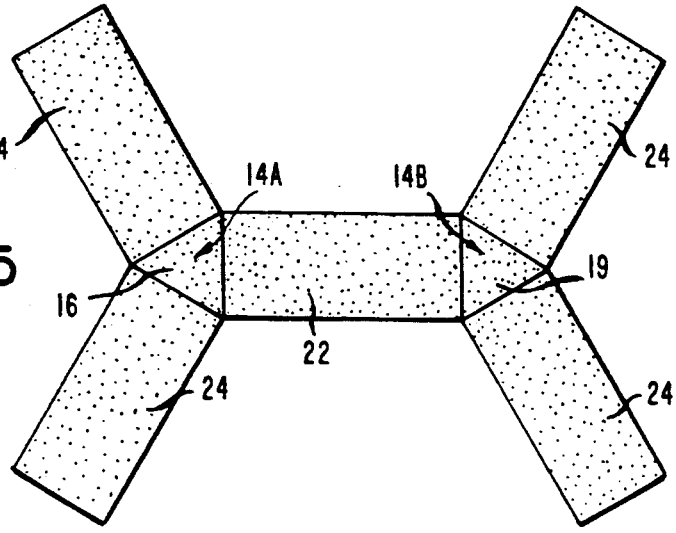
FIG. 5 is a bottom plan view of the ferrite element shown in FIG. 3.

Referring now to FIGS. 1 and 2 of the drawings, there is shown a microstrip high reverse loss isolator constructed in accordance with the teachings of the present invention comprising a microstrip dielectric substrate, indicated generally as 10, which has a planar top surface 11 and a planar bottom surface 12. The substrate 10 may comprise a section of conventional microstrip transmission line substrate which is usually fabricated of Duroid or other similar dielectric material having a relatively low dielectric constant. An electrically conductive ground plane 13 which is fabricated of a good conducting metal, such as copper or silver, for example, is mounted on the bottom surface 12 of the substrate and covers that entire surface.

Figure 6:
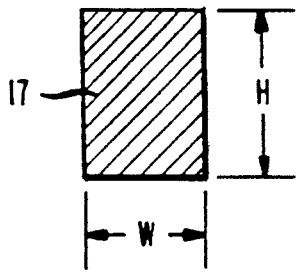
FIG. 6 is a full sectional view taken along the line 6—6 of FIG. 4 showing a prism face of one of the pair of central portions of the ferrite element.
Figure 7:
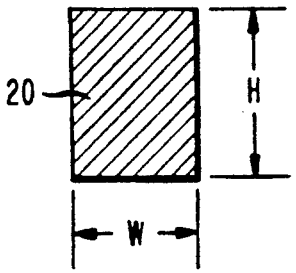
FIG. 7 is a full sectional view taken along the line 7—7 of FIG. 4 showing a prism face of the other of the pair of central portions of the ferrite element.

A ferrite element indicated generally as 14, is mounted on the top surface 11 of the substrate 10. The element 14 may be fabricated of a ferrite material, such as nickel zinc ferrite or lithium ferrite, for example, which exhibits gyromagnetic behavior in the presence of a unidirectional magnetic field. As may be seen in FIGS. 3 through 7 of the drawings, although the ferrite element 14 is shown as a monolithic structure, it may be thought of as having a pair of spaced apart central portions, indicated generally as 14A and 14B, a connecting arm portion 14C and four transition arm portions 14D. Each of the ferrite element central portions 14A and 14B is shaped as a right prism and the four transition arm portions 14D and the commonly-shared connecting arm portion 14C extend radially outwardly from the central portions. The prism shaped central portion 14A has a top prism base 15 and a bottom prism base 16, each of which is shaped as an equilateral triangle. The bottom prism base 16 abuts the top surface 11 of the substrate 10. The prism shaped central portion 14A also has three rectangular prism faces 17 of equal area as shown in FIG. 6 of the drawings. Central portion 14B of the ferrite element 14 similarly has a top prism base 18 and a bottom prism base 19, each shaped as an equilateral triangle, and three rectangular prism faces 20 of equal area as shown in FIG. 7 of the drawings. Again, the bottom prism base 19 of the central portion 14B abuts the top surface 11 of the substrate 10.

The connecting arm portion 14C extends radially outwardly from and joins one of the prism faces 17 of the ferrite element central portion 14A to one or the prism faces 20 of the ferrite element central portion 14B. The ferrite element central portions 14A and 14B are so positioned and dimensioned that the two prism faces which are joined by the connecting arm portion 14C are parallel to each other and have substantially the same height and width. Accordingly, the ferrite element connecting arm portion 14C may be bar shaped and may have a height and width which are substantially the same as the height and width of the two prism faces which it joins. The top surface 21 of the connecting arm portion 14C joins the top base 15 of the ferrite element central 14A to the top base 18 of the central portion 14B and is substantially coplanar with both of these top prism bases. Similarly, the bottom surface 22 of the connecting army portion 14C connects the bottom prism bases 16 and 19 of the ferrite element central portions 14A and 14B, respectively, so that the bottom surface 22 is substantially coplanar with these bottom bases.

The four transition arm portions 14D of the ferrite element 14 extend radially outwardly from the four remaining prism faces of the pair of ferrite element central portions 14A and 14B which are not connected by the connecting arm portion 14C. Each of the ferrite element transition arm portions is substantially triangular in shape and has a height which decreases linearly from the full height H of the top prism base above the bottom prism base of the central portion from which it extends at the end of the transition arm portion which abuts the prism face to zero height at the other end of the transition arm portion, so that the top surface 23 of each of the transition arm portions 14D slopes downwardly from the top prism base of the central portion from which it extends to the top surface 11 of the substrate 10 and the bottom surface 24 of each transition arm portion is coplanar with the bottom prism base of the central portion from which it extends and also abuts the top surface 11 of the substrate 10. Preferably, each of the ferrite element transition arm portions 14D has a width which is substantially equal to the width W of the prism face from which it extends. The height H and width W of the prism faces of the pair of ferrite element central portions 14A and 14B are shown in FIGS. 6 and 7 of the drawings.

Referring again to FIGS. 1 and 2 of the drawings it will be seen that each of the arm portions 14C and 14D of the ferrite element 14 has electrically conductive microstrip conductor means, indicated generally as 25, associated therewith. The microstrip conductor means 25 has a first portion thereof 25A mounted on the top bases 15 and 18 of the pair of ferrite element central portions 14A and 14B and the top surface 21 of the ferrite element connecting arm portion 14C, a second portion thereof 25B extending down the sloping top surface 23 of the ferrite element transition arm portion 14D associated therewith and a third portion 25C thereof mounted on the top surface 11 of the substrate 10 in alignment with the ferrite element transition arm portion 14D associated therewith. Since the top and bottom prism bases of each of the ferrite element central portions 14A and 14B are shaped as equilateral triangles, it follows that with respect to each of the ferrite element central portions the ferrite element arm portions 14C and 14D and the portions 25A, 25B and 25C of the microstrip conductor means 25 associated with that arm portion are spaced 120 degrees apart in a Y-junction oriented configuration on the top surface 11 of the substrate 10. The microstrip conductor means 25 should, of course, be fabricated of a good electrically conductive metal, such as copper or silver, for example.

As seen in FIG. 2 of the drawings, a small, high-energy permanent magnet 26 is mounted on the ground plane 13 directly below the bottom prism base 16 of the ferrite element central portion 14A. The permanent magnet 26 may be cylindrical and should have a diameter which is sufficient to cover the entire bottom prism base 16 of the ferrite element central portion 14A so that a unidirectional or dc magnetic field is applied between the top and bottom prism bases 15, 16 of the central portion 14A as indicated schematically by the arrow 27 in FIG. 2. Similarly, a cylindrical permanent magnet 28 is mounted on the ground plane 13 directly below the bottom prism base 19 of the ferrite element central portion 14B and serves to produce a unidirectional magnetic field, indicated by the arrow 29, between the top and bottom prism bases 18, 19 of the ferrite element central portion 14B. It is important to note that the magnetic fields 27 and 29 produced by the magnets 26 and 28, respectively, must be in the same magnetic direction. The permanent magnets 26 and 28 may obviously be replaced by permanent magnets of different shape or by some other magnetic biasing means which will provide the necessary unidirectional magnetic fields 27 and 29 in the same magnetic direction.

By virtue of the foregoing arrangement, the ferrite element central portion 14A in conjunction with the applied unidirectional magnetic field from the permanent magnetic 26 acts as a ferrite circulator with respect to electromagnetic wave energy applied to the three prism faces 17 of that central portion. The operation of a ferrite circulator of this type is described in U.S. Pat. No. 4,415,871 which was issued to the inventors of the present invention on Nov. 15, 1983 and is assigned to the assignee of the present application. Similarly, the ferrite element central portion 14B in conjunction with the applied unidirectional magnetic field from the permanent magnet 28 acts as another ferrite circulator with respect to electromagnetic wave energy applied to the three prism faces 20 of that central portion. The three ferrite element arm portions 14C and 14D which extend radially outwardly from the three prism faces of each of the ferrite element central portions 14A and 14B together with the substrate 10 and the microstrip conductor means portions 25A, 25B and 25C associated with the arm portions enable each of the ferrite element central portions 14A and 14B to act as a microstrip Y-junction circulator. The operation of a Y-junction microstrip circulator of this type is described in U.S. Pat. No. 4,749,966 which was issued to the inventors of the present invention on Jun. 7, 1988 and is assigned to the assignee of the present application.

Figure 8:
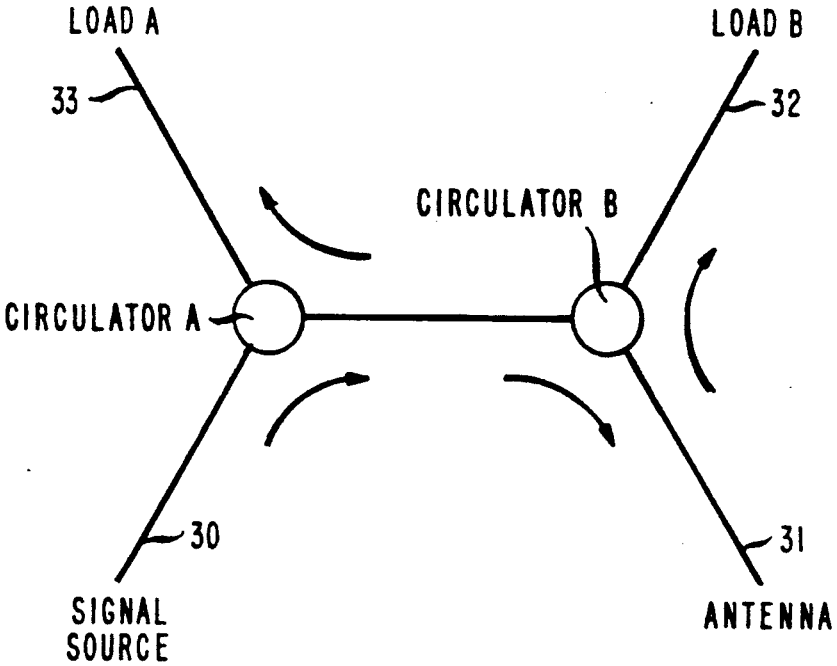
FIG. 8 is a schematic diagram useful in explaining the operation of the microstrip isolator of the invention.

In the present invention, the pair of microstrip Y-junction circulators formed by the ferrite element central portions 14A and 14B have a commonly shared ferrite element arm portion, i.e., the ferrite element connecting arm portion 14C, which effectively connects the two microstrip Y-junction circulators in tandem as shown in the schematic diagram of FIG. 8 of the drawings wherein circulator A is the microstrip Y-junction circulator formed by the ferrite element central portion 14A and circulator B is the microstrip Y-junction circulator formed by ferrite element central portion 14B. The resulting tandem connected pair of microstrip Y-junction circulators would have a total of four ports which are formed by the four microstrip conductor means portions 25C. These four ports have been designated 30, 31, 32 and 33 in FIGS. 1 and 8 of the drawings.

The operation of the high reverse loss isolator of the invention will be described with reference to FIGS. 1 and 8 of the drawings wherein it is assumed that the isolator is used to protect a signal source, such as a RF transmitter, for example, which is feeding an antenna from unwanted high energy millimeter wave signals which could enter the system via the antenna and could damage or impair the operation of the overall system. The signal from the signal source is applied to port 30 of circulator A and, as described in said U.S. Pat. No. 4,749,966, is propagated in a microstrip transmission line mode of propagation along the microstrip conductor means portion 25C coupled to that port until it reaches the junction between microstrip conductor means portions 25B and 25C. At that point, the ferrite element transition arm portion 14D and the microstrip conductor means portion 25B associated therewith gradually convert the propagation mode of the signal from the microstrip mode to the solid waveguide mode of transmission as described in said U.S. Pat. No. 4,749,966 so that by the time the signal reaches the prism face 17 of the ferrite element central portion 14A associated therewith the signal is being propagated in the solid waveguide mode of propagation. With a counterclockwise rotational direction of circulator coupling action, as shown by the directional arrows associated with circulator A in FIG. 8, the signal is then transmitted in the solid waveguide mode of propagation to circulator B which is formed by the ferrite element central portion 14B by means of the ferrite element connecting arm portion 14C. Since the unidirectional magnetic field 29 which is applied to ferrite element central portion 14B by means of the permanent magnet 28 is in the same magnetic direction as the magnetic field 27 applied to ferrite element central portion 14A, circulator B will also have a counterclockwise rotational direction of circulator coupling action so that the signal is transmitted to port 31 to which the antenna is coupled by means of the ferrite element transition arm portion 14D and the microstrip conductor means portions 25B and 25C associated with that port. Again, the ferrite element transition arm portion 14D and the microstrip conductor means portion 25B associated therewith serve to gradually convert the solid waveguide mode of propagation of the signal back into the microstrip mode of propagation so that by the time the signal is coupled to the antenna it is entirely again in the microstrip line transmission mode of propagation. The signal transmission from the signal source to the antenna would be accomplished with very little loss.

Unwanted high energy millimeter wave signals striking the antenna would enter the isolator by means of the port 31 and because of the counterclockwise rotational direction of circulator coupling action of the circulator B would be transmitted to port 32 which would be terminated by an energy dissipating load B. Any leakage from circulator B of the unwanted high energy millimeter wave signal which could travel back to circulator A by means of ferrite element connecting arm portion 14C which joins the two circulators in tandem would typically be at least 15 db down in power level. This attenuated unwanted signal would then be coupled by circulator A to isolator port 33 which would be coupled to another energy dissipating load A. By this time, any of the unwanted high energy millimeter wave signal from the antenna that could reach the signal source through circulator A would be down at least 30 db in power level and would not damage or destroy the sensitive signal source module.

As described above, the isolator of the invention will not only accomplish signal transmission in the forward direction with a very low loss but will also provide a very high reverse loss with respected to unwanted signals entering the system and travelling back in the reverse direction. The microstrip high reverse loss isolator of the invention is far superior to any circuit arrangement utilizing two separate microstrip circulators of the type described in said U.S. Pat. No. 4,749,966 joined in tandem by means of a section of microstrip transmission line because the ferrite element 14 with its bar shaped connecting arm portion 14C eliminates the need for the two ferrite element transition arm portions and the length of microstrip transmission line connection which would otherwise be needed. The ferrite element connecting arm portion 14C of the invention permits the signal to travel from one circulator portion to the other circulator portion in the solid waveguide mode of propagation only and provides a very low loss transmission of the signal from the input port 30 of the isolator to the output port 31. Additionally, the high reverse loss isolator of the invention would be of a much smaller size than any arrangement utilizing two separate tandem joined microstrip circulators. The ferrite element 14 of the isolator of the invention is monolithic in construction because the two central portions 14A, 14B, the four transition arm portions 14D and the single connecting arm portion 14C are integral parts of the element. Accordingly, the ferrite element 14 could easily be produced in production quantities by molding ferrite powder into the required size and shape and then firing it into final form. Although the foregoing portions of the ferrite element 14 could be fabricated separately and then bonded together, the insertion of the necessary bond would probably increase the impedance and overall insertion loss of the isolator to no advantage. It is therefore apparent that the microstrip isolator of the invention readily lends itself to automated assembly techniques and possesses all of the fabrication advantages of the microstrip circulator described in said U.S. Pat. No. 4,749,966.

During fabrication of the isolator, the portions 25A and 25B of the microstrip conductor means 25 may comprise a first length of microstrip conductor means which is deposited on the top surfaces of the ferrite element arm portions and the top bases of the ferrite element central portions. The third portions 25C of the microstrip conductor means which are formed on the top surface 11 of the substrate 10 may be formed of second lengths of microstrip conductor which are electrically interconnected to the electrically unitary first length of microstrip conductor on the ferrite element 14 after the ferrite element is put in place on the surface of the substrate. Alternatively, the portions 25A, 25B and 25C of the microstrip conductor means could comprise a single length of microstrip conductor which is formed after the ferrite element is in place on the surface of the substrate.

It is believed apparent that many changes could be made in the construction and described uses of the foregoing high reverse loss microstrip isolator and many seemingly different embodiments of the invention could be constructed without departing from the scope thereof. For example, although the isolator of the invention has been described with reference to use in the millimeter wave region of the frequency spectrum, it is apparent that the circulator is not limited in use to applications in that frequency region. Accordingly, it is intended that all matter contained in the above description or shown in the accompanying drawings shall be interpreted as illustrative and not in a limiting sense.

What is claimed is:

1. A microstrip high reverse loss isolator comprising a microstrip dielectric substrate having substantially planar top and bottom surfaces;

an electrically conductive ground plane mounted on the bottom surface of said substrate;

a ferrite element mounted on the top surface of said substrate, said ferrite element having a pair of spaced apart central portions, each of said central portions being shaped as a right prism having three rectangular prism faces of substantially equal area and top and bottom prism bases shaped as equilateral triangles, the bottom prism base of each of said pair of central portions abutting the top surface of said substrate, a connecting arm portion extending radially outwardly from and joining one of the prism faces of one of said pair of central portions to one prism face of the other of said pair of central portions, said connecting arm portion having a top surface joining the top bases of said pair of central portions and a bottom surface joining the bottom bases of said pair of central portions, and four transition arm portions extending radially outwardly from the four remaining prism faces of said pair of central portions, each of said transition arm portions having a height which decreases linearly from the full height of the top prism base above the bottom prism base of the central portion from which it extends at the end of the transition arm portion which abuts the prism face to zero height at the other end of the transition arm portion, so that the top surface of each of said transition arm portions slopes downwardly from the top prism base of the central portion from which it extends to the top surface of said substrate and the bottom surface of each transition arm portion is coplanar with the bottom prism base of the central portion from which it extends and abuts the top surface of said substrate;

electrically conductive microstrip conductor means associated with each of said ferrite element arm portions, said microstrip conductor means having a first portion thereof mounted on the top bases of said pair of ferrite element central portions and the top surface of said ferrite element connecting arm portion, a second portion thereof extending down the sloping top surface of the ferrite element transition arm portion associated therewith and a third portion thereof mounted on the top surface of said substrate in alignment with the ferrite element transition arm portion associated therewith;

energy dissipating load means terminating each of the third portions of said microstrip conductor means associated with two of said four ferrite element transition arm portions, said two transition arm portions being disposed at opposite ends of one of the sides of said ferrite element connecting arm portion; and magnetic biasing means for applying dc magnetic fields having the same magnetic direction between the top and bottom prism bases of said pair of prism shaped ferrite element central portions to cause said pair of ferrite element central portions to act as a pair of tandem connected microstrip Y-junction circulators and the third portions of said microstrip conductor means associated with the remaining two of said four ferrite element transition arm portions to act as the ports of the microstrip isolator.

2. A microstrip high reverse loss isolator as claimed in claim 1 wherein said ferrite element central portions and said ferrite element arm portions are integral parts of said ferrite element so that said ferrite element is monolithic in construction.

3. A microstrip high reverse loss isolator as claimed in claim 2 wherein said prism faces of said one of said pair of ferrite element central portions have substantially the same height and width as the height and width of the prism faces of the other of said pair of ferrite element central portions, said one prism face of said one of said pair of ferrite element central portions is substantially parallel to said one prism face of said other of said pair of ferrite element central portions, said ferrite element connecting arm portion is bar shaped and has a height and width which are substantially the same as the height and width of the prism faces which it joins, so that said top surface of said connecting arm portion is substantially coplanar with said top prism bases of said pair of ferrite element central portions and said bottom surface of said connecting arm portion is substantially coplanar with said bottom bases of said pair of ferrite element central portions, and each of said ferrite element transition arm portions is triangular in shape and has a width substantially equal to the width of the prism face from which it extends.

4. A microstrip high reverse loss isolator as claimed in claim 2 wherein each of said electrically conductive microstrip conductor means comprises a first length of microstrip conductor forming said first and second portions thereof, and a second length of microstrip conductor forming said third portion thereof, said first and second lengths of microstrip conductor being electrically interconnected at said other end of the ferrite element transition arm portion associated therewith.

5. A microstrip high reverse loss isolator as claimed in claim 2 wherein each of said microstrip conductor means comprises a single length of microstrip conductor forming said first, second and third portions thereof.

6. A microstrip high reverse loss isolator as claimed in claim 2 wherein said magnetic biasing means comprises permanent magnet means mounted on said ground plane beneath the bottom bases of said pair of ferrite element central portions.

* * * * *